US006368503B1

(12) United States Patent
Williamson et al.

(10) Patent No.: US 6,368,503 B1
(45) Date of Patent: Apr. 9, 2002

(54) FILTERED FLUID DISPENSING SYSTEM

(75) Inventors: Bruce S. Williamson, Alpharetta; Michael S. Brunner, Roswell; Jeffrey E. Fish, Dacula; Kevin P. McGrath, Alpharetta; Malcolm D. Poirier, Marietta, all of GA (US); Paul Metaxatos, Collinsville; Dave Mathieu, Colchester, both of CT (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/430,771

(22) Filed: Oct. 29, 1999

Related U.S. Application Data

(60) Provisional application No. 60/141,485, filed on Jun. 29, 1999.

(51) Int. Cl.[7] ..... B01D 24/16; B01D 27/08

(52) U.S. Cl. ..... 210/282; 210/422; 210/428; 210/433.1; 210/435; 210/460; 210/470; 4/675; 4/678; 4/287; 4/288; 4/292

(58) Field of Search ..... 210/418, 420, 210/422, 424, 433.1, 435, 428–429, 431, 470, 460, 282; 222/189.06; 137/601.01, 883; 4/675, 678, 903, 287, 570, 615, 693, DIG. 14, DIG. 19, 288, 292; 239/413–414, 416.2–416.3, 553.3, 553.5, 562–563, 565, 443–444

(56) References Cited

U.S. PATENT DOCUMENTS

| | | | | |
|---|---|---|---|---|
| 2,830,618 | A | * | 4/1958 | Mitchell |
| 3,038,610 | A | | 6/1962 | Hetherington |
| 3,593,707 | A | * | 7/1971 | Pifer |
| 3,690,565 | A | | 9/1972 | Abos |
| 3,789,991 | A | | 2/1974 | Krongos |
| 3,917,172 | A | * | 11/1975 | O'Hare |
| 4,107,046 | A | | 8/1978 | Corder |
| 4,147,631 | A | | 4/1979 | Deines et al. |
| 4,187,986 | A | | 2/1980 | Petrovic |
| 4,284,078 | A | * | 8/1981 | Pace |
| 4,556,484 | A | | 12/1985 | Hunter et al. |
| 4,595,500 | A | | 6/1986 | Galbiati |
| 4,599,171 | A | | 7/1986 | Padilla et al. |
| 4,674,687 | A | | 6/1987 | Smith et al. |
| 4,744,895 | A | * | 5/1988 | Gales et al. ..... 210/96.2 |
| 4,808,109 | A | * | 2/1989 | Thornton |
| 4,863,103 | A | | 9/1989 | Gannaway |
| 4,933,080 | A | | 6/1990 | Rundzaitis et al. |
| 5,103,856 | A | * | 4/1992 | Fleischmann |
| 5,108,606 | A | | 4/1992 | Maglio |
| 5,127,427 | A | | 7/1992 | Kajpust et al. |
| 5,158,234 | A | * | 10/1992 | Magnenat et al. |
| 5,192,427 | A | | 3/1993 | Eger et al. |
| 5,194,156 | A | | 3/1993 | Tomchak |
| 5,213,688 | A | | 5/1993 | Robinson |
| 5,277,802 | A | | 1/1994 | Goodwin |
| 5,277,828 | A | * | 1/1994 | Fleming ..... 210/792 |

(List continued on next page.)

FOREIGN PATENT DOCUMENTS

| | | | | |
|---|---|---|---|---|
| DE | 4031764 | A1 | | 2/1992 |
| EP | 775860 | A2 | * | 5/1997 |
| EP | 0775860 | A | | 5/1997 |
| EP | 0896176 | A2 | | 2/1999 |
| EP | 896176 | A2 | * | 2/1999 |

OTHER PUBLICATIONS

International Search Report dated Oct. 9, 2000.

*Primary Examiner*—Matthew O. Savage
*Assistant Examiner*—Marianne Ocampo
(74) *Attorney, Agent, or Firm*—Dority & Manning, P.A.

(57) ABSTRACT

The present invention provides a filtered fluid dispensing system. The invention may replace the sprayer provided with the faucet assembly of a conventional sink and may, in certain embodiments, be adapted to selectively dispense filtered and unfiltered fluid.

29 Claims, 9 Drawing Sheets

U.S. PATENT DOCUMENTS 5,279,324 A * 1/1994 Schutz et al.
5,290,443 A 3/1994 Norton
5,316,216 A 5/1994 Cammack et al.
5,510,031 A 4/1996 Knauf, Jr. et al.
D373,173 S 8/1996 Valley et al.
D378,122 S 2/1997 Milrud et al.
5,608,928 A * 3/1997 Wang ..... 4/678
5,699,832 A 12/1997 Burchard et al.
D392,023 S 3/1998 Milrud et al.
5,735,467 A * 4/1998 Lee
5,744,033 A * 4/1998 Bertrand et al.
5,788,160 A * 8/1998 Woog
D406,317 S 3/1999 Hill et al.
D409,721 S 5/1999 Burchard et al.
5,928,504 A 7/1999 Hembre et al.
D415,822 S 10/1999 Ouyoung
5,983,938 A * 11/1999 Bowers et al.

* cited by examiner

FILTERED FLUID DISPENSING SYSTEM

The present invention is based on provisional patent application Ser. No. 60/141,485 filed Jun. 29, 1999, and priority is hereby claimed therefrom.

FIELD OF THE INVENTION

The present invention relates generally to a filtered fluid dispensing system, and more particularly to a filtration system employing a sprayer in which a filter media is housed for dispensing filtered fluid.

BACKGROUND OF THE INVENTION

Water intended for human consumption or for use in certain applications employing a sprayer in which a filter media is housed for dispensing is expected to be either free of harmful constituents or contain concentrations of such constituents that are below harmful levels. To provide water for use in homes and businesses, municipalities utilize industrial scale processes in an effort to eliminate or reduce harmful constituents present in water drawn from large, naturally occurring water sources. Potable water is also frequently obtained on a smaller scale from wells and springs and usually without any treatment prior to consumption.

Unfortunately, the cleanliness of a particular water supply is sometimes questionable. The consistency and efficiency of treatment by municipalities may vary due to numerous factors such as heavy rainfall, equipment failures, and usage levels. Depending upon the seriousness of a variation in treatment, a municipality may be forced to notify its users that further treatment of the water supplied, e.g. boiling, is required at the point of use before consumption or use is safe. Water obtained directly from a natural source may also become suspect depending upon environmental conditions near the source. For example, wells and springs can become contaminated due to rain water run-off washing a contaminant into the source.

In response, fluid filtration devices have been developed. Such devices range from those located at the point-of-use (e.g. the spigot of a kitchen sink, gravity-flow dispensers such as water pitchers, and low-pressure dispensers such as sports bottles) to the generally bulkier point-of-entry units hidden from view within the plumbing of a home or office.

While a particular application may require the availability of both filtered and unfiltered liquid, current devices may not allow the user to select between filtered and unfiltered flow. For example, existing point-of-entry units generally provide filtered fluid to all points-of-use within a dwelling or building regardless of whether filtered fluid is needed at each location. Existing point-of-use systems provide filtered fluid at specific locations, but may not allow selection between filtered fluid and unfiltered fluid. Some point-of-use systems are installed at the end-of-tap of the faucet assembly provided with a conventional sink. However, these systems tend to be bulky and consume space needed for using the sink. Current end-of-tap systems are offset to the side of the tap and may required a large housing to contain the filter media. In addition to consuming space, these units may not be aesthetically acceptable to consumers.

Accordingly, a need exists for liquid filtration devices suitable in size and scale for residential or office use. In addition, a system is also needed that allows the user to select between filtered fluid and unfiltered fluid. Even more desirably, there exists a need for a filtered fluid system that saves space when used with the faucet assembly of a conventional sink.

SUMMARY OF THE INVENTION

The present invention provides a system for dispensing filtered fluid at the point-of-use. In specific embodiments, the present invention provides a filtered fluid dispensing system that may be used to selectively dispense filtered fluid or unfiltered fluid. The system may include a flexible conduit connected to a dispenser housing equipped with a nozzle such that the filtered fluid dispensing system may by used as a sprayer when dispensing filtered or, in some embodiments, unfiltered fluid.

The filtered fluid dispensing system includes a dispenser housing with an unfiltered fluid inlet through which unfiltered fluid may enter the housing and a filtered fluid outlet through which filtered fluid may exit the housing. At least one valve is structured within the housing and is in fluid communication with the unfiltered fluid inlet and the filtered fluid outlet. At least one actuator, in mechanical communication with the valve, allows the flow of fluid through the dispenser housing to be externally controlled. A filter is also located within the dispenser housing so that the system may dispense filtered fluid through the filtered fluid outlet. Accordingly, upon using the actuator to activate the valve, unfiltered fluid may enter the dispenser housing through the unfiltered fluid inlet, pass through the filter contained within the dispenser housing, and exit the housing through the filtered fluid outlet.

The filtered fluid dispensing system of the present invention may also be connected to the water supply of a conventional kitchen sink, or may replace the sprayer provided with the faucet assembly of a conventional sink. The user is thereby provided with a system for dispensing filtered fluid with a sprayer for consumption, cleaning, and the like. In some embodiments, the filtered fluid dispensing system may allow the user to select between filtered fluid and unfiltered fluid, thereby providing the user with a choice depending upon the particular application. In addition, the dispenser housing of the present invention may be structured so that filtered water may be dispensed without requiring removal of the dispenser housing from the dispenser support on the sink. The valving of the dispenser housing may be configured to provide for a continuous on position to aid with filling large containers such as pots used with cooking.

For installations where the present invention is connected to the sprayer connection of a conventional sink, the filtered fluid dispensing system may include various features for ensuring that the existing water pressure is sufficient to properly operate the shuttle valve located in a conventional faucet assembly. By way of example only, the dispenser housing may be directly connected to the main unfiltered fluid supply so as to by-pass the shuttle valve. Alternatively, a separate valve may also be added to the fluid outlet of the conventional faucet assembly to direct fluid flow into the dispensing system. In still another alternative, a boosting mechanism may be provided that assists the shuttle valve to ensure its proper operation when the filtered fluid dispensing system is utilized. Provision may also be made for the near instantaneous switching from the flow of unfiltered fluid to filtered fluid from the dispensing system such that the shuttle valve continues to properly operate when the system is dispensing filtered fluid.

Additional features may also be incorporated into the present invention. By way of example only, the filtered fluid dispensing system may include an unfiltered fluid outlet through which unfiltered fluid may exit the dispenser housing. In accordance therewith, a valve may be structured to allow either filtered or unfiltered fluid to exit the dispenser housing. The valve may be activated by a single actuator structured to allow selective dispensing from the system, or may include a first and second actuator acting upon the valve for dispensing filtered and unfiltered fluid respectively from the dispenser housing.

In some embodiments, the filtered fluid dispensing system may include two valves, one each for the filtered fluid and unfiltered fluid. In this embodiment two actuators are provided, each one in mechanical communication with a valve, whereby the user may select either filtered or unfiltered fluid for dispensing from the dispenser housing.

In another embodiment, the filtered fluid dispensing system may include two valves, one each for the filtered fluid and unfiltered fluid. The valves are then connected to a single actuator structured to allow the present invention to dispense either filtered or unfiltered fluid from the dispenser housing. In still another embodiment, the present invention may include two actuators, each in mechanical communication with a single valve. The valve is structured to allow the dispensing of either filtered or unfiltered fluid depending upon which actuator the user activates.

Additional valves or valving mechanisms, additional actuators, and additional fluid outlets may also be utilized in various embodiments to allow selective dispensing of either filtered or unfiltered fluid from the housing.

The dispenser housing may be structured to allow the ready removal of the filter for replacement with a new filter. The filter media selection may depend on the volume of flow, the type of impurities, and the identity of the fluid being filtered. For water filtration, the filter media may include activated charcoal, a charge-modified material, or an ion-exchange resin, or zeolite-containing materials. These serve only as examples as other media are available or may be developed that can be used in conjunction with the present invention. The filter media may be granular, laminated, packed, extruded, or the like. Additionally, the dispenser housing may be structured to accept filters having a variety of physical shapes.

An indicator may be included to notify the user that the filter has reached the end of its useful life. By way of example only, the indicator may have an electronic sensor that notifies the user through a light bar or other visible means the status of the filter's remaining life. The sensor may measure filter life based upon the total volume of flow, number of uses, changes in the volume flow through the dispenser housing, and the like. Alternatively, the indicator may simply notify the user that the filter media is spent.

These and other features, aspects and advantages of the present invention will become better understood with reference to the following description and appended claims. The accompanying drawings, which are incorporated in and constitute a part of this specification, illustrate an embodiment of the invention and, together with the description, serve to explain the principles of the invention.

Figure 1:
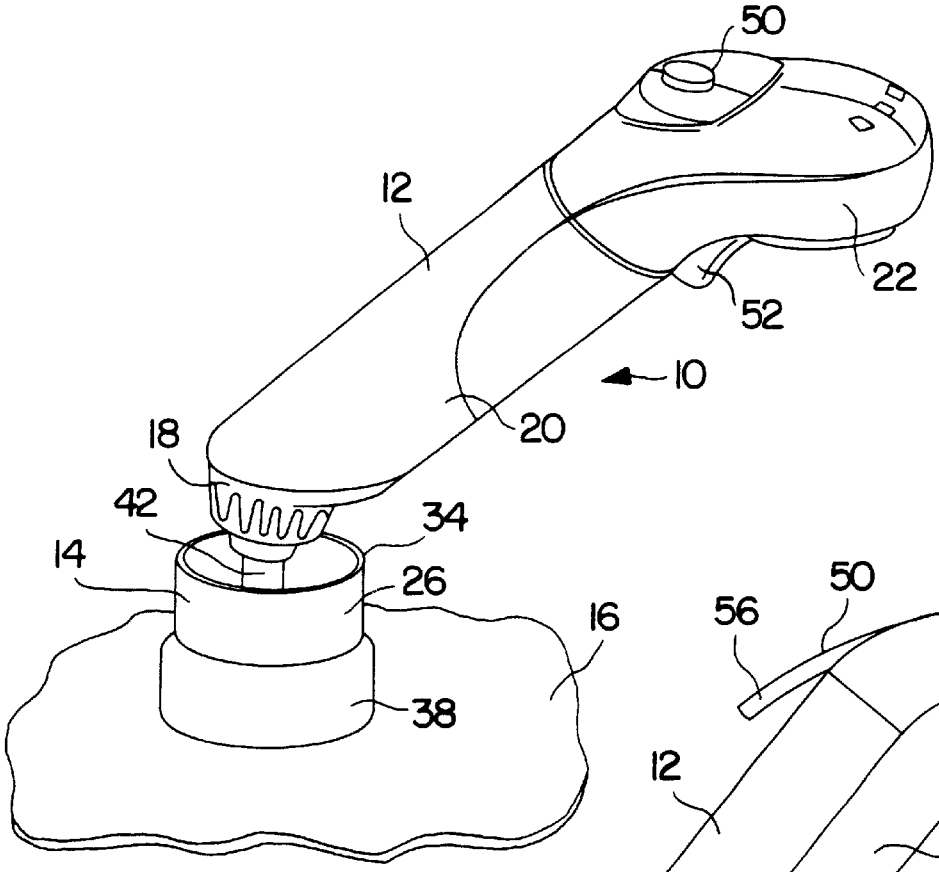
FIG. 1 is a perspective view of an embodiment of a filtered fluid dispensing system according to the present invention.

Repeat use of reference characters in the present specification and drawings is intended to represent same or analogous features of elements of the invention.

DETAILED DESCRIPTION OF THE PREFERRED EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention.

Figure 15:
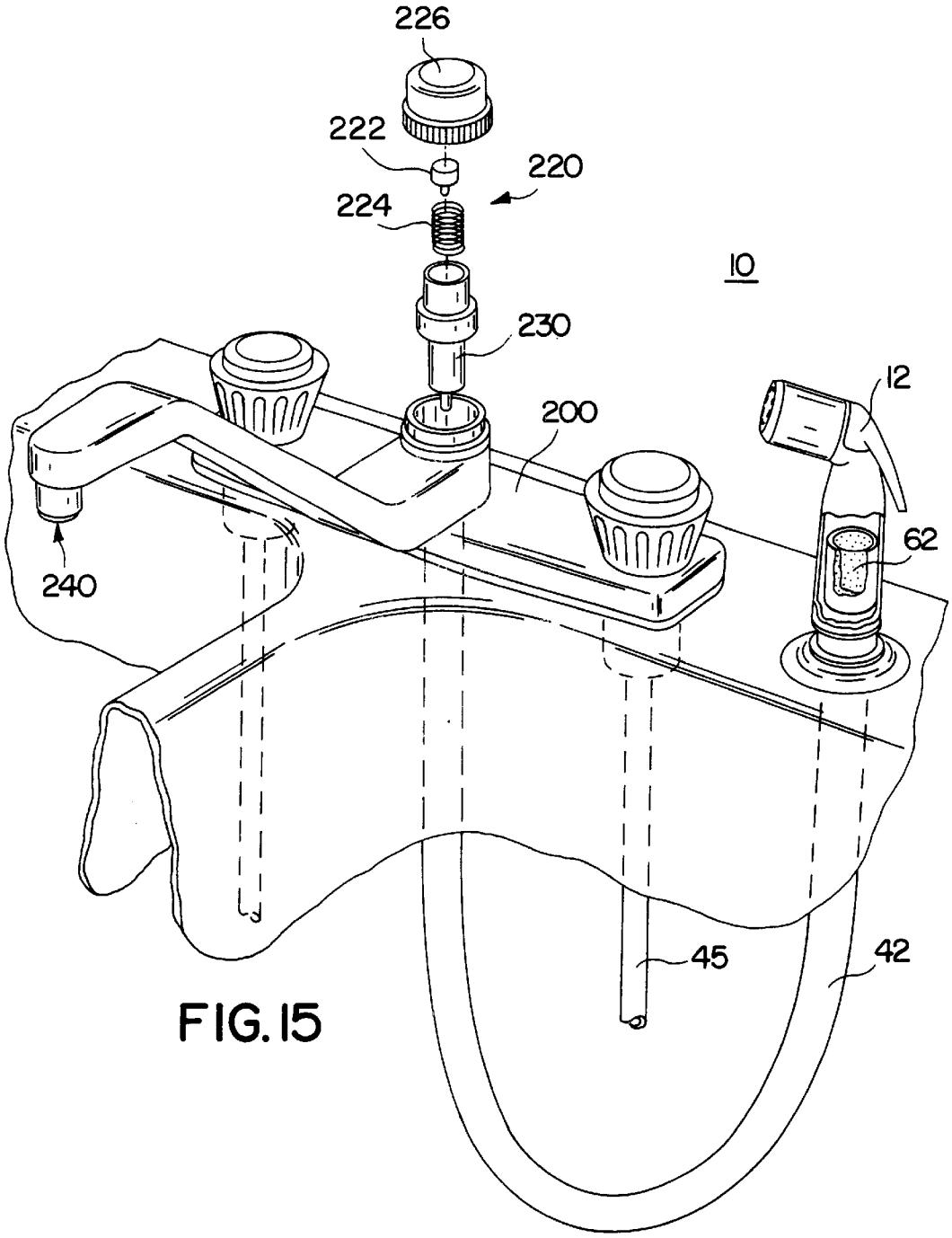
FIG. 15 is a perspective view of a portion of a faucet assembly employing a filtered fluid dispensing system according to the present invention with portions in exploded form and portions in see-through form.

As used herein, the words "faucet assembly" mean a typical valve assembly installed in a conventional sink that generally includes a mixing base containing a cold water valve, a hot water valve, a spigot, a water sprayer connected to the mixing base of the faucet assembly by a flexible conduit, and a shuttle valve for directing the flow of water to the water sprayer when it is activated. An exemplary faucet assembly is depicted in FIG. 15. A faucet assembly could be used to dispense a fluid other than water. This definition and the present invention are not limited to water use only.

Figure 2:
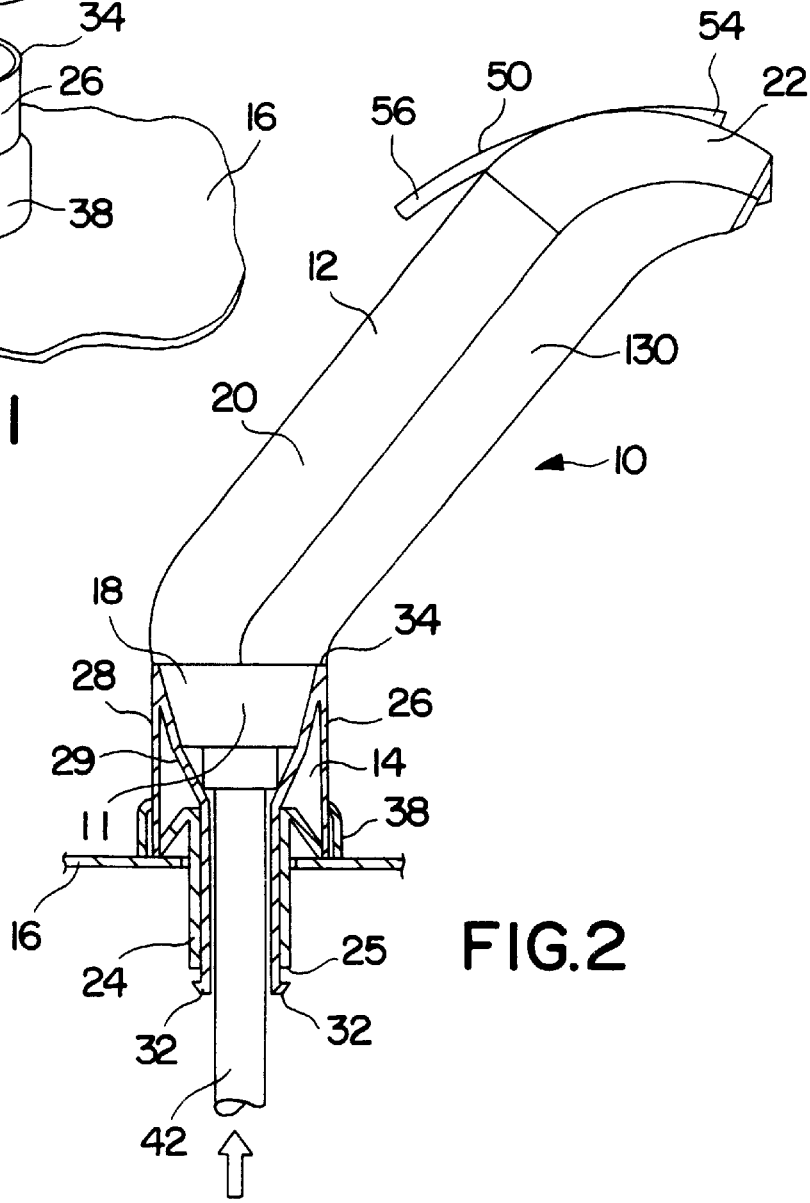
FIG. 2 is a partial cross-sectional side view of another embodiment of a filtered fluid dispensing system according to the present invention.
Figure 9:
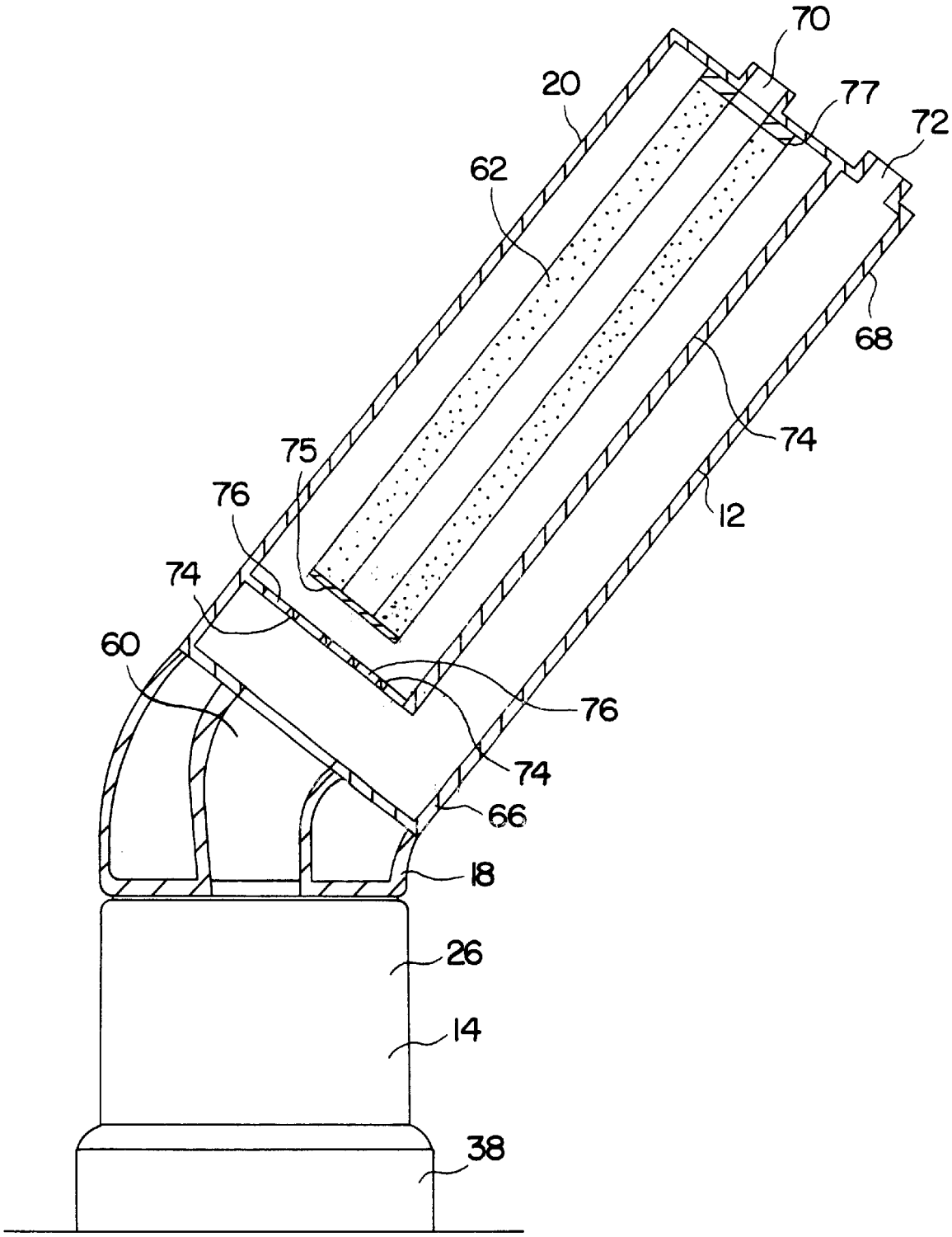
FIG. 9 is a partial cross-sectional view of the central portion of the dispenser housing, the base of the dispenser housing, and the dispenser housing support.

FIGS. 1 and 2 depict two exemplary embodiments of a filtered fluid dispensing system 10. Referring to FIGS. 1, 2, 9, and 11, the filtered fluid dispensing system 10 includes an unfiltered fluid inlet 11, through which unfiltered fluid may be supplied into the dispenser housing 12. The system includes a filtered fluid outlet 126, through which filtered fluid may exit the dispenser housing 12. The filtered fluid dispensing system 10 also includes a valve 110 within the dispenser housing 12. The valve 110 being in fluid communication with the unfiltered fluid inlet 11 and the filtered fluid outlet 126; and an actuator 50 in mechanical communication with the valve 110 such that the flow of fluid through the housing may be externally controlled. As shown in FIG. 9, a filter 62 is held within the dispenser housing 12 in fluid communication with the unfiltered fluid inlet 11 and the filtered fluid outlet 126 so that the filtered fluid dispensing system 10 may provide filtered fluid through the filtered fluid outlet 126.

Referring to FIGS. 1 and 2, the dispenser housing 12 may be releasably mounted upon a surface 16 such as a kitchen sink or counter top using a dispenser support 14, which is adapted to support the dispenser housing 12. The dispenser support 14 may also be adapted to position the dispenser housing 12 over a sink whereby, if desired, a user may activate the actuator 50 of the dispenser housing 12 (for example, by pressing the actuator) to dispense fluid into the sink, or into a container positioned therein, without removing the dispenser housing 12 from the dispenser support 14.

A flexible conduit 42 is connected to the unfiltered fluid inlet and provides unfiltered fluid to the dispenser housing 12 from an unfiltered fluid supply. In some embodiments, a first actuator 50 may be activated to cause the filtered fluid dispensing system 10 to dispense filtered fluid by moving said-first-actuator 50 towards a forward portion 22 of said dispenser housing 12. As shown in FIG. 1, a second actuator 52, mounted in or on housing 12, may be activated by moving said second actuator 52 towards the forward portion 22 of said dispenser housing 12 to cause the filtered fluid dispensing system 10 to dispense unfiltered fluid.

The dispenser housing 12 includes, in certain embodiments, a base 18, a central portion 20, and the forward portion 22. Each such portion of the dispenser housing 12 may be separable from the other portions or may be integrally formed with one or more of the other portions. For example, and as shown in the embodiments depicted in FIGS. 7–10, the central portion 20 may form part of the dispenser housing 12 and have an upper end 68 and a lower end 66, the lower end 66 being adapted to engage the base 18. A wide assortment of mechanisms may be utilized to attach the base 18 to the central portion 20 of the dispenser housing 12 such as, for example, snap fit, interlocking threads, bayonette mount, twist mount or fasteners. In the embodiments depicted in FIGS. 8 and 9, the base 18 snap-fits with the central portion 20. The dispenser housing 12 may be formed into a variety of shapes and may be constructed from plastics, metal, and other materials suitable for contact with the particular fluid being dispensed.

Figure 10:
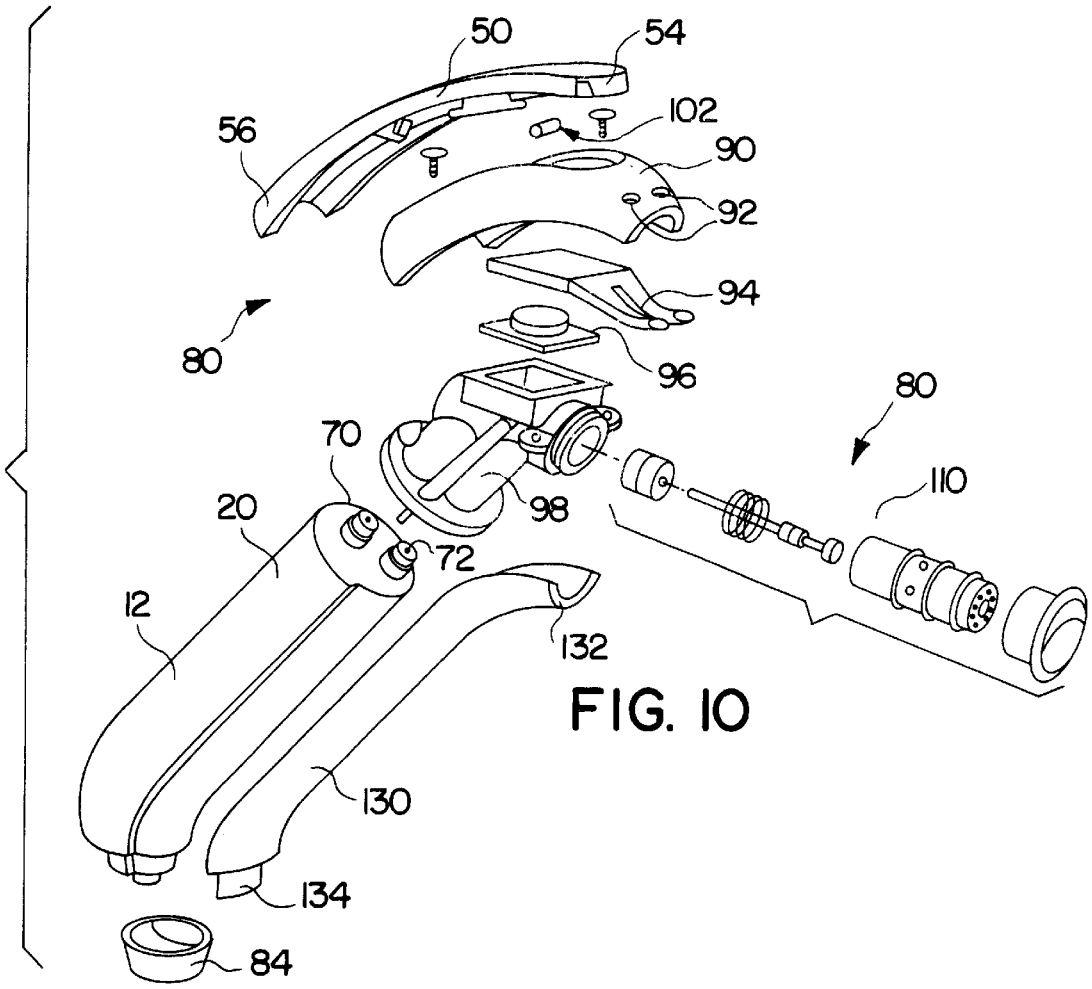
FIG. 10 is an exploded view of an embodiment of the dispenser housing depicted in FIG. 2.

In certain embodiments and as shown in FIGS. 2 and 10, a brace 130 may further be provided, the brace 130 having an upper end 132 and a lower end 134, with the upper end 132 being attached to the forward portion 22 of the dispenser housing 12, and with at least a portion of the central portion 20 being adjacent to the brace 130. A ring 84 may also be provided to releasably engage the lower end 134 of the brace 130 to the central portion 20.

Figure 3:
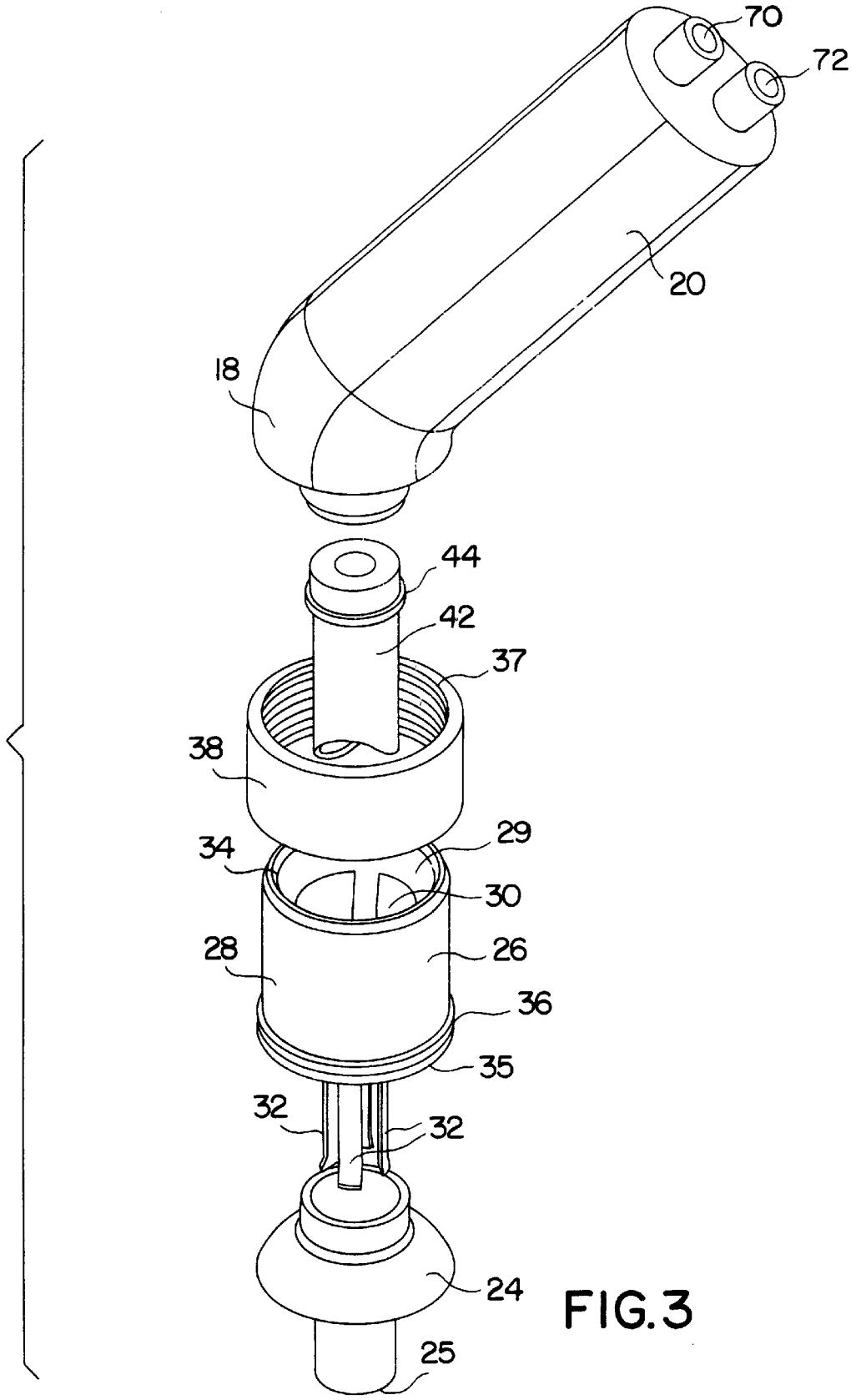
FIG. 3 is an exploded view of an embodiment of a dispenser housing support according to the present invention.
Figure 6:
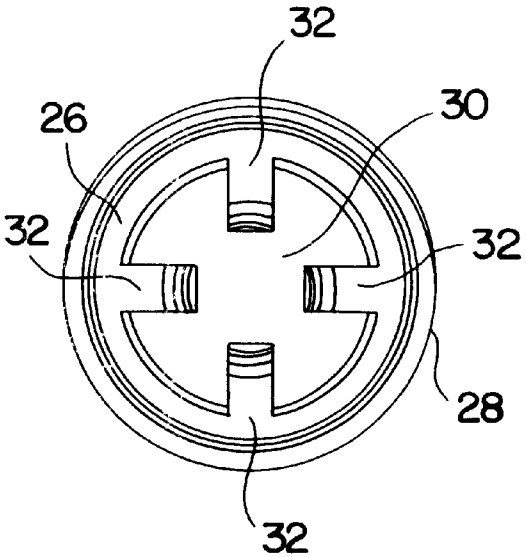
FIG. 6 is a bottom view of the embodiment of the dispenser housing support fitting depicted in FIG. 4.

While a variety of dispenser supports may be utilized in the present invention, the dispenser support 14 may be adapted to be easily placed over any one of a variety of conventional sprayer mountings commonly utilized with the faucet assembly of a conventional sink. An example of a conventional sprayer mounting 24 is depicted in FIGS. 2 and 3, the conventional sprayer mounting 24 including an upper annular portion which rests on the surface 16 and a hollow cylindrical portion which extends through an aperture in the surface 16. In a conventional faucet assembly with a conventional sprayer, a flexible conduit 42 is connected to the end of the conventional sprayer. The flexible conduit 42 may have a fitting 44 attached to the flexible conduit 42. The flexible conduit 42 with fitting 44 is passed through the hollow cylindrical portion of the standard sink sprayer mounting 24. The flexible conduit 42 is connected to a source of unfiltered water on one end. On the other end, utilizing the fitting 44, the flexible conduit 42 may be releasably attached to a conventional sink sprayer. The fitting 44 prevents fluid loss during operation.

Figure 5:
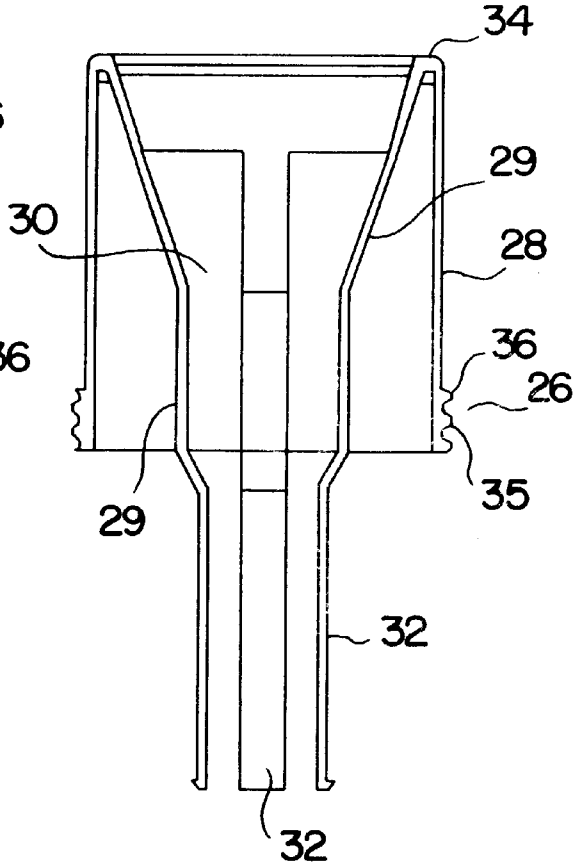
FIG. 5 is a cross-sectional view of the embodiment of the dispenser housing support fitting depicted in FIG. 4, taken along line 5—5.

As depicted in FIGS. 1–6, the dispenser support 14 of the present invention may be annular and may include a support fitting 26 and an annular collar 38. The support fitting 26 may be variously configured to support the dispenser housing 12. In the embodiment depicted in FIGS. 1–5, the support fitting 26 includes a support surface 34 upon which the dispenser housing 12 may be supported. The interior of the support fitting 26 may be angled, as shown in FIG. 5, to provide further support for the dispenser housing 12. Additional support may be provided by other interlocking features disposed on the dispenser housing 12 and/or the support fitting 26. For example, a detent may be formed in the dispenser housing 12 which engages a boss disposed on the support fitting 26.

Figure 4:
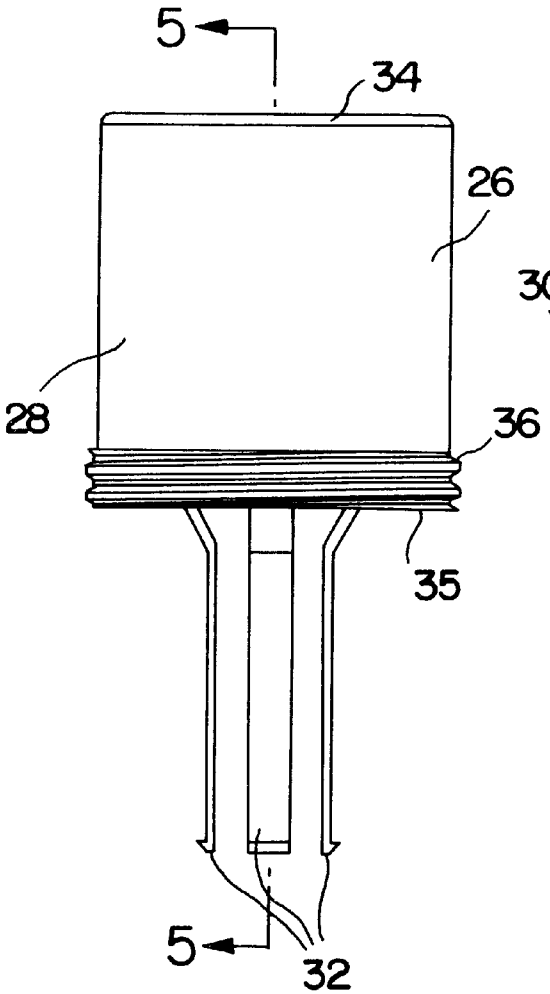
FIG. 4 side view of an embodiment of a dispenser housing support fitting according to the present invention.

As best seen in FIGS. 2–6, the support fitting 26 may further include an external wall 28 and an interior wall 29, the interior wall 29 forming an interior channel 30. Although the support fitting 26 may be variously formed, in some embodiments the support fitting 26 is formed as a unitary piece and the interior wall 29 is contiguous with the exterior wall 28 as shown in FIGS. 2, 3, and 5. In some embodiments and as seen in FIGS. 3–5, the interior wall 29 is continuous proximate to the support surface 34 to provide sufficient rigidity to the support fitting 26 to support the dispenser housing 12. Away from the support surface, the 15; interior wall 29 forms at least one and, in particular embodiments, a plurality, of flexible lock fingers 32.

As shown in FIGS. 2 and 3, lock fingers 32 and interior wall 29 are adapted to be positioned within the standard sprayer mounting 24 so that a user may disconnect the flexible conduit 42 from the conventional sink sprayer, thread the flexible conduit through the support fitting 26, align the lock fingers 32 with the interior of the conventional sprayer mounting 24, and then slide the support fitting 26 downward. When the lock fingers 32, which flex inwardly during insertion into the standard sprayer mounting, flex outwardly, the ends of the lock fingers 32 extend beyond the end 25 of the conventional sprayer mounting 24 and the support fitting 26 is positioned over the conventional sprayer mounting 24.

As shown in FIGS. 1, 2, and 3, an annular collar 38 may be placed over the exterior of the support fitting 26 after the support fitting 26 has been installed over the conventional sprayer mounting 24. The annular collar 38 may be formed to assist in retaining the support fitting 26 in the desired position. A retention mechanism 36 may also be provided to retain the annular collar 38 in the proper position. In certain embodiments, as in the embodiments depicted in FIGS. 3–6, the retention mechanism 36 includes an external thread 35 positioned on the exterior surface of the support fitting 26 and a mating internal thread 37 positioned on the interior surface of the collar 38.

As shown in the embodiments depicted in FIGS. 1, 2, 3, and 7, the base 18 of the dispenser housing 12 may engage the flexible conduit 42 of the conventional sprayer discussed above. A variety of base 18 configurations are possible to enable the base 18 to engage the flexible conduit 42 of a conventional sprayer. For example and as depicted in FIG. 3, the flexible conduit fitting 44 may snap into the lower portion of the base 18. In alternate embodiments and as shown in the embodiment depicted in FIG. 7, the base 18 may rotatably engage the flexible conduit fitting 44. A washer 40 may be provided to seal this connection.

Figure 8:
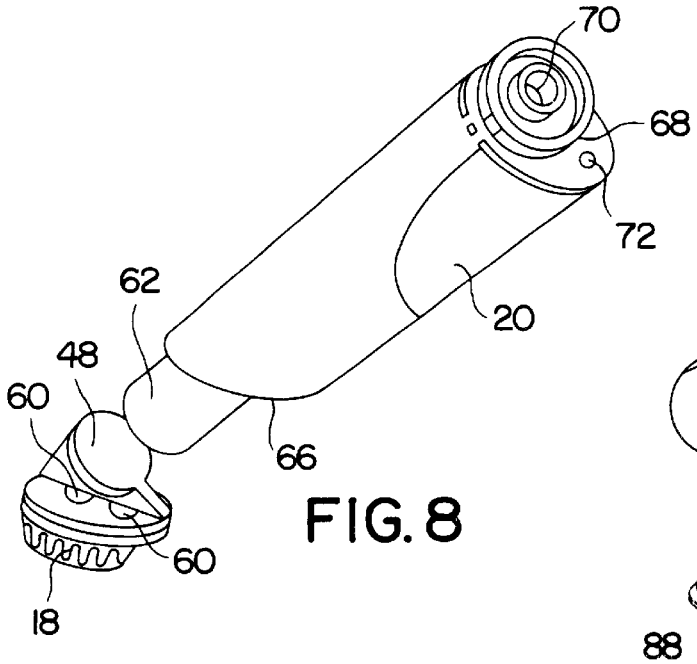
FIG. 8 is an exploded view of the central portion of the filtered fluid dispensing system depicted in FIG. 7.

Although the base 18 of the dispenser housing 12 may be variously formed, the base 18 includes at least one unfiltered fluid inlet channel 60, best shown in FIGS. 8 and 9. Each unfiltered fluid inlet channel 60 is in fluid communication with the unfiltered fluid inlet 11 and the flexible conduit 42 so that unfiltered fluid may flow from flexible conduit through the unfiltered fluid inlet 11 and into the unfiltered fluid inlet channel 60 in base 18.

The central portion 20 of the dispenser housing 12 extends between base 18 and the forward portion 22 of the dispenser housing 12. The exterior of the central portion 22 may be configured to be easily grasped by a user. In particular embodiments, a filter 62 may be disposed within the central portion 20, although a filter 62 may be disposed in the other portions of the dispenser housing 12. Regardless, the present invention houses at least a portion of the filter 62 within the dispenser housing 12.

A wide variety of filters may be utilized in the present invention, such as, for example, block activated carbon, granular activated carbon, nonwoven materials, ion-exchange resins, charge-modified materials, zeolite containing materials, and combinations of such and similar materials. A laminate of materials or an extruded material may also be used. In certain embodiments, a block activated carbon filter is utilized. As shown in FIGS. 8 and 9, the filter 62 may be substantially cylindrical having a hollow center. A first end cap 75 and a second end cap 77 are sealingly attached to each end of the filter 62 so that fluid must pass from the exterior, through the filter material, and into the center of the filter 62. The second end cap 77 is disposed proximate to the filtered fluid outlet port 70 and has an aperture formed therein so that fluid which has passed through the filter media may flow out of the filter 62 through the filtered fluid outlet port 70. Block activated carbon filters such as depicted and described herein are commonly used in a variety of fluid filtration applications.

As shown in FIG. 8, the filter 62 may be retained within the dispenser housing 12 by a protruding member 48 on the base 18. In such an embodiment, the filter 62 may be replaced by disengaging the base 18 from the central portion 20, removing the filter 62, placing a new filter 62 into the central portion 20, and reattaching the base 18 to the lower end 66 of the central portion 20.

As shown in the embodiments depicted in FIGS. 1, 2, 8, 9, and 11, the central portion 20 may include a filtered fluid outlet port 70 in fluid communication with the unfiltered fluid inlet channel 60 with the filter 62 being disposed between the filtered fluid outlet port 70 and the unfiltered fluid inlet channel 60. Unfiltered fluid may flow from the flexible conduit 42 to the unfiltered fluid inlet 11 and into base 18 through unfiltered fluid inlet channel 60. Unfiltered fluid may then pass through the filter 62, become filtered fluid, and then exit the central portion 20 through the filtered fluid outlet port 70. The filtered fluid outlet port is in fluid communication with the filtered fluid outlet 126 whereby filtered fluid may exit the dispenser housing 12.

In certain embodiments and as shown in FIG. 9, a partition 74 may be formed within the interior of the central portion 20. The partition 74 may be formed about the filter 62, the partition 74 having a plurality of apertures 76 so that fluid entering the central portion 20 of the dispenser housing 12 may pass through the partition 74 and flow through the filter 62.

Figure 11:
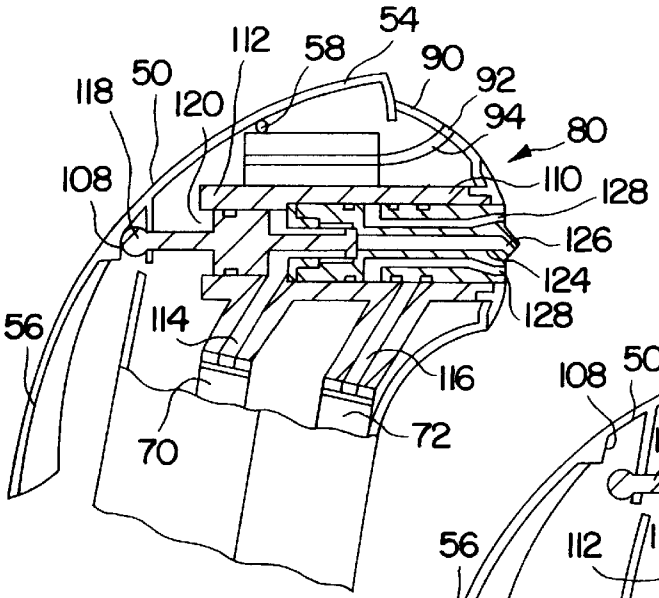
FIG. 11 is a partial cross-sectional side view of the forward portion of the dispenser housing depicted in FIG. 2 with the dispenser housing shown in the "off" position.

As depicted in FIGS. 9 and 11, such embodiments may further include an unfiltered fluid outlet port 72 in fluid communication with the unfiltered fluid inlet channel 60 in the base 18. Unfiltered fluid entering the central portion 20 of the dispenser housing 12 may pass through to the unfiltered fluid outlet port 72 and thereby by-pass filter 62. The unfiltered fluid outlet port 72 is in fluid communication with the unfiltered fluid outlet 128, whereby unfiltered fluid may exit the dispenser housing 12. Accordingly, upon activating the valve mechanism to dispense unfiltered fluid, unfiltered fluid flows from the unfiltered fluid inlet 11, through unfiltered fluid inlet channel 60, enters the central portion 20, flows outside the partition 74 but within the dispenser housing 12, through unfiltered outlet port 72, and then may exit the dispenser housing 12 through unfiltered fluid outlet 128.

Referring again to FIGS. 1, 7, 8, and 9, the dispenser housing 12 may further include a forward portion 22 which engages the upper end 68 of the central portion 20. The forward portion 22 may be variously configured, but is adapted to dispense filtered fluid and/or unfiltered fluid from the central portion 20 of the dispenser housing 12.

Figure 7:
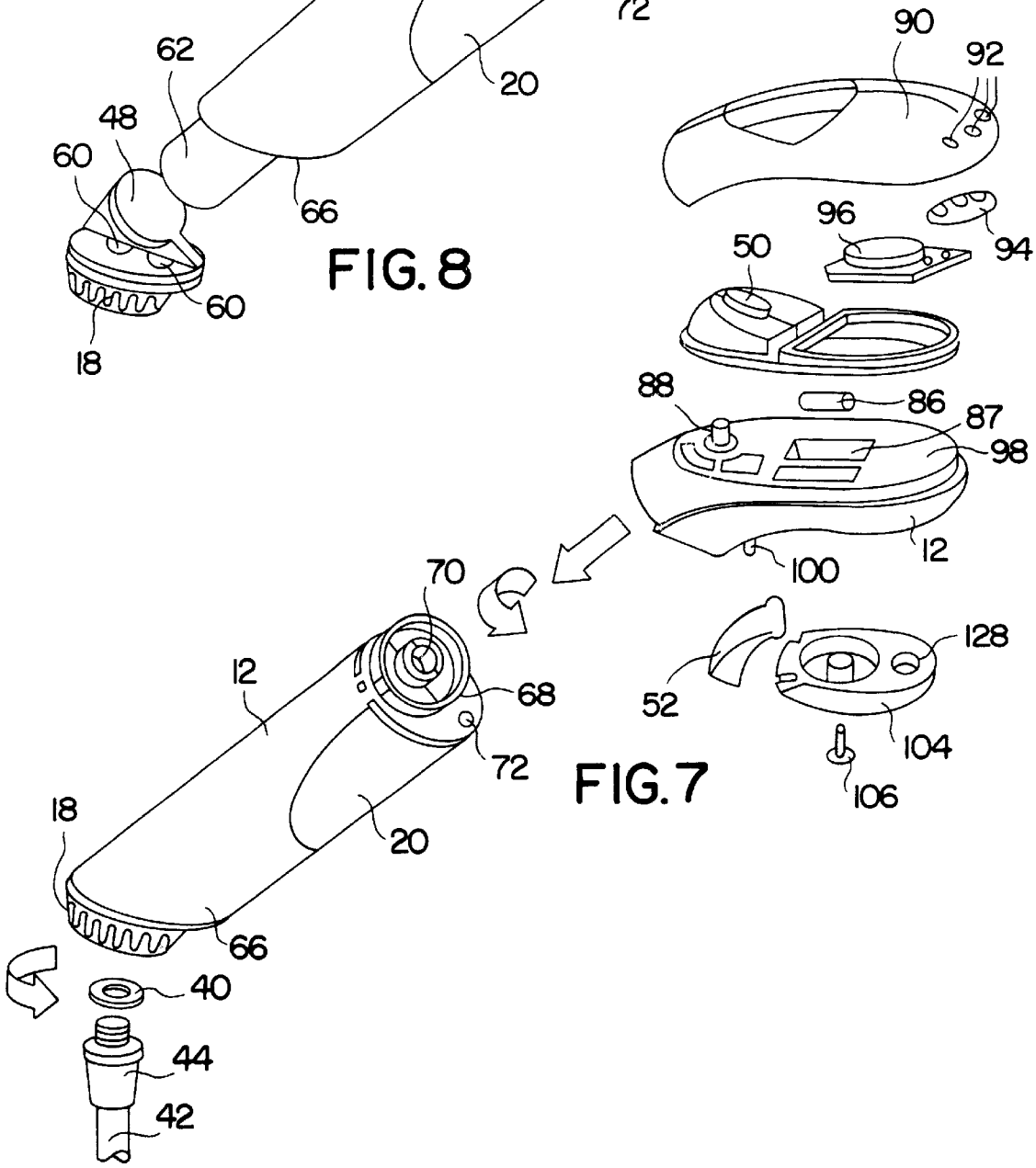
FIG. 7 is a perspective, partially exploded view of an embodiment of the filtered fluid dispensing system.

In some embodiments, an indicator is disposed at least partially within the forward portion 22 which indicates that the filter 62 should be replaced with a fresh filter. For example and as shown in the embodiments depicted in FIGS. 7 and 10, the cover 90 may include at least one aperture 92 formed therein. As shown in FIG. 7, three apertures 92 are utilized, and, in FIG. 10, two apertures are utilized.

The apertures 92 may be variously positioned on the dispenser housing 12 and with respect to each other.

The indicator disposed within the forward portion 22 includes a mechanism for generating light such as an electronic module 96 and a light pipe 94 which may be disposed beneath the apertures 92 so that light within the light pipe 94 is visible through the aperture 92. The module 96 may generate a visual indication via the light pipe 94 when a particular period of time has elapsed, or a particular amount of fluid has passed through the filtered fluid outlet port 70, or any of a number of measurements which may indicate that the filter 62 has reached the end of its useful life.

As shown in FIGS. 1, 7, and 10, the cover 90 may snap onto a body 98 forming part of the forward portion 22 of the dispenser housing 12. Within the dispenser housing 12 is disposed any one of a variety of valving mechanisms. By way of example only, single or multiple valves may be activated by either single or multiple actuators to dispense filtered fluid only, or to allow selective dispensing of either filtered fluid or unfiltered fluid.

For example, as shown in FIG. 7, a valve may be utilized within the body 98 that includes a shuttle 86 which fits within an aperture 87 formed in the body 98. A first actuator 50 is in mechanical communication, through a first button 88, with the valve structured into the forward portion 22 of the dispenser housing 12. Upon activating the first actuator 50, filtered fluid may exit the dispenser housing 12 through the filtered fluid outlet 126. A second actuator 52 may be attached to the bottom portion 104 of the forward portion 22 with a fastener 106. The second actuator is in mechanical communication with the valve through a second button 100. Upon activating the second actuator 52, unfiltered fluid may be exit from the dispenser housing 12 through the unfiltered fluid outlet 128.

In still another example, a single actuator 50 may be used in combination with any one of a variety of valving mechanisms to dispense either filtered or unfiltered fluid from the dispenser housing 12. As depicted in FIGS. 2, 10, and 11-13, a single actuator and single valve assembly 80 may be provided In such an embodiment, the actuator 50 may include a forward portion 54 and a rearward portion 56. The actuator 50 pivots about point 58, shown in each of FIGS. 11–13. The pivot may be a pin 102. The actuator 50 may further includes a boss 108 disposed on the interior of the actuator 50 for mechanical connection with the single valve.

Figure 13:
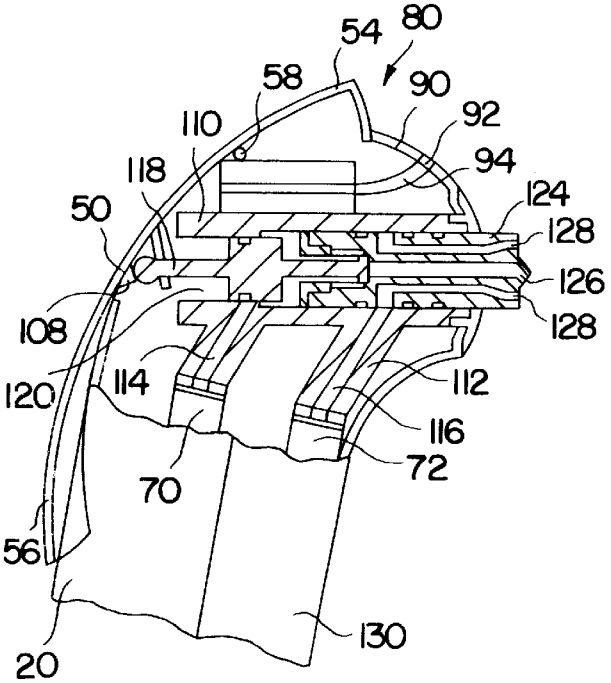
FIG. 13 is a partial cross-sectional side view of the forward portion of the dispenser housing depicted in FIG. 2 with the dispenser housing shown in the "non-filtering dispensing" position.
Figure 12:
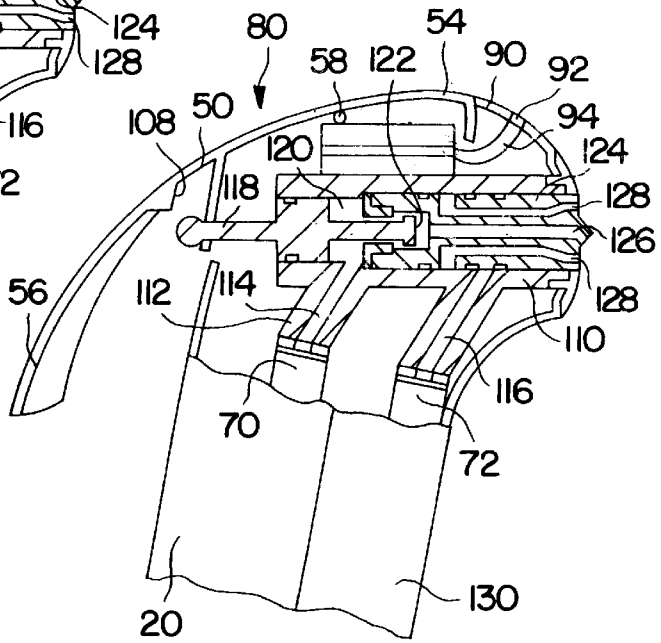
FIG. 12 is a partial cross-sectional side view of the forward portion of the dispenser housing depicted in FIG. 2 with the dispenser housing shown in the "filtering dispensing" position.

FIG. 11 is a partial cross-sectional side view of the forward portion 22 of the filtered fluid dispensing system 10 depicted in FIG. 2; the dispensing system is shown in the "off" position. FIG. 12 is a partial cross-sectional side view of the forward portion 22 of the dispenser depicted in FIG. 2, the dispenser shown in the "filtering dispensing" position. FIG. 13 is a partial cross-sectional side view of the forward portion 22 of the dispenser depicted in FIG. 2, the dispenser shown in the "non-filtering dispensing" position.

As shown in FIGS. 11–13, a valve 110 is provided, which includes a valve housing 112 including a central bore 120, a filtered fluid channel 114, and an unfiltered fluid channel 116. A shuttle 118 is slidably received within the central bore 120 of the valve housing 112. As shown in FIG. 12, the shuttle 118 includes a forward sealing surface 122.

An insert 124 may be disposed within the central bore 120 with at least a portion of the shuttle 118 being slidably received within the insert 124. The insert 124 includes, in some embodiments, at least one filtered fluid outlet 126, and at least one unfiltered fluid outlet 128.

FIG. 11 depicts the dispenser in the "off" position. When a user desires to dispense filtered fluid from the dispenser housing 12, the user depresses the forward portion 54 of the actuator 50, as depicted in FIG. 12. The actuator 50 pivots about pivot point 58, moving the rearward portion 56 of the actuator 50 away from the dispenser housing 12. Thus, the boss 108 is moved out of engagement with the shuttle 118. The shuttle 118 is biased rearwardly so that, when the boss 108 is moved out of engagement with the shuttle 118, the shuttle 118 moves rearward within the valve housing 112. The forward sealing surface 122 of the shuttle 118 is moved away from and out of engagement with the portion of the insert 124 proximate to the rearmost opening of the filtered fluid dispensing channel 126. Movement of the shuttle 118 thus creates a flow path for filtered fluid within the central bore 120, permitting fluid to flow from the filtered fluid outlet port 70, through the filtered fluid channel 114, around the insert 118 and through the filtered fluid dispensing channel 126. When the actuator 50 is activated to dispense filtered water, the unfiltered fluid outlet port 72 and the unfiltered fluid channel 116 are blocked by the insert 124, thus preventing unfiltered fluid from flowing out of the dispenser housing 12. When the user releases the actuator 50, the actuator returns to the position depicted in FIG. 11, the boss 108 of the actuator 50 forcing the forward sealing surface 122 of the shuttle 118 back into engagement with the rearmost opening of the filtered fluid dispensing channel 126, thus preventing the flow of filtered fluid from the dispenser housing 12.

When the user desires to dispense unfiltered fluid from the dispenser housing 12, the user depresses the rearward portion 56 of the actuator 50, as shown in FIG. 13. As the actuator 50 pivots about the pivot point 58, the boss 108 is moved forward, thus moving the shuttle 118 forward. The movement of the shuttle 118 moves the insert 124 forward, permitting the alignment of the unfiltered fluid channel 116 with the unfiltered fluid dispensing channel 128. Thus, unfiltered fluid is permitted to exit from the dispenser housing 12.

When the actuator 50 is returned to the "off" position, the shuttle 118 and insert 124, which is also biased rearwardly, return to their "off" positions, depicted in FIG. 11, thus stopping the flow of unfiltered fluid from exiting the dispenser housing 12.

Additional valve and actuator combinations and mechanisms may be readily envisioned using the teachings provided by the present invention. By way of example only, the filtered fluid dispensing system may include a single valve activated by a single actuator that only provides for dispensing filtered fluid. Alternatively, the filtered fluid dispensing system may include a single valve in combination with two actuators that provides for the selective dispensing of either filtered fluid or unfiltered fluid.

Any of a variety of nozzles may be structured into fluid communication with the filtered fluid outlet 126 or unfiltered fluid outlet 128. Accordingly, a variety of differently shaped streams of fluid may be released from the dispensing system 10. In addition, the filtered fluid outlet 126 or unfiltered fluid outlet 128 may be configured each with a variety of nozzles from which the user may select depending upon the application. For example, a rotating dial with a selection of nozzles may be provided for each fluid outlet.

As discussed above, the filtered fluid dispensing system may be used in conjunction with the faucet assembly of a conventional sink to provide filtered water and, in certain embodiments, unfiltered water. For these applications, the user may simply replace the existing sprayer supplied with the faucet assembly.

Generally, the faucet assembly includes a shuttle valve within the assembly. When the user opens the valves of the faucet assembly, the shuttle valve directs the flow to the water outlet of the faucet or spigot. When the user activates the water sprayer, the shuttle valve automatically redirects the flow of water to the sprayer. Proper operation of the shuttle valve is dependent upon the water pressure and flow rate of the water supply.

Fluid filtration may introduce some degree of pressure drop in any given fluid stream being filtered regardless of whether it involves filtration with the present invention or any other currently available filter. As a result, the shuttle valve within the faucet assembly of a conventional sink may not function properly when an additional pressure drop is introduced into the water sprayer because the pressure of the existing water supply may not be sufficient. The present invention includes embodiments to circumvent this limitation of the conventional shuttle valve.

Figure 14:
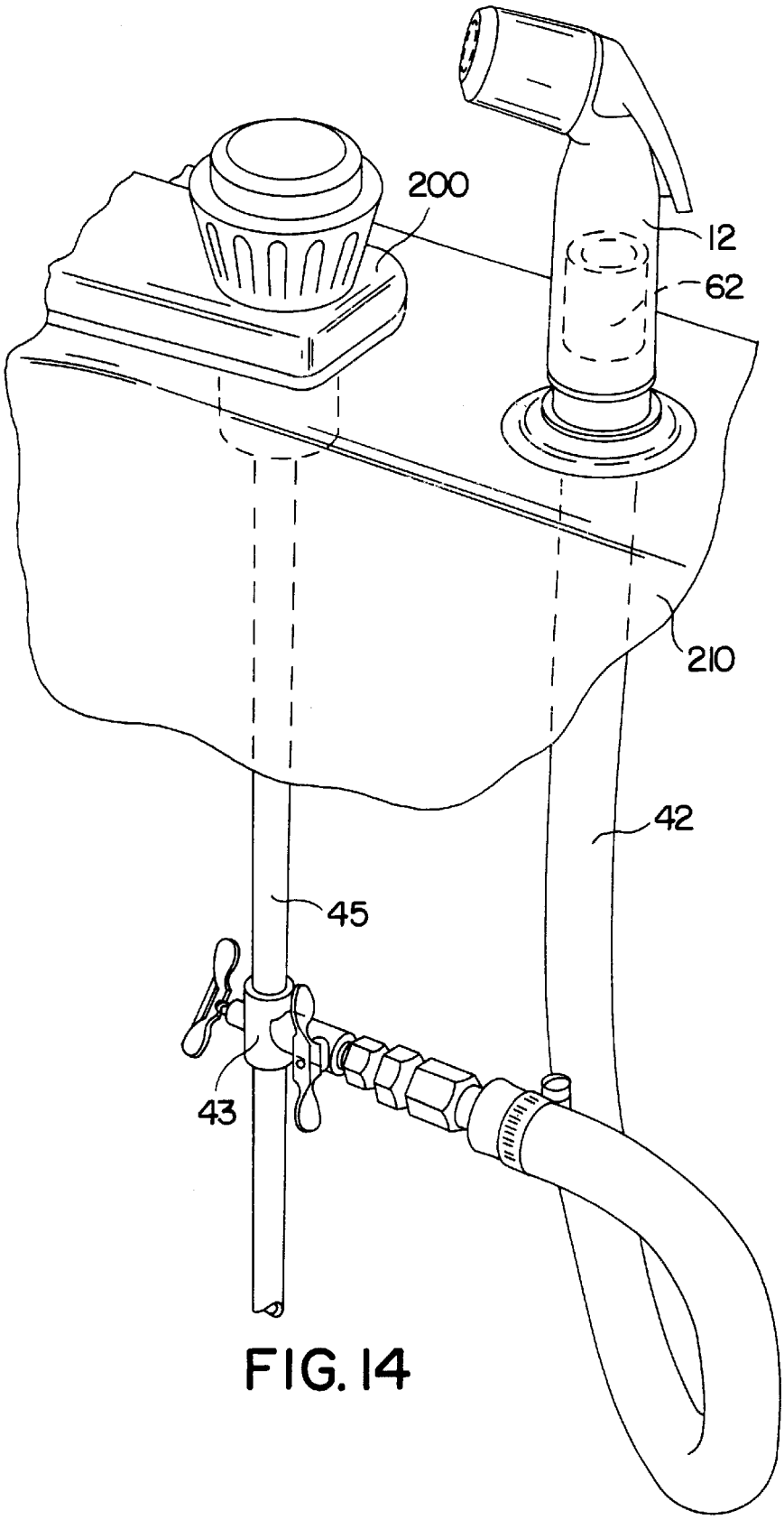
FIG. 14 is a perspective view of a portion of a faucet assembly employing a filtered fluid dispensing system according to the present invention.

FIG. 14 depicts another embodiment of the present invention in which the dispenser housing 12 with filter 62 is used with the faucet assembly 200 of a conventional sink 210. In this embodiment, the filtered fluid dispensing system is directly connected to the unfiltered fluid supply 45 by the flexible conduit 42 with a clamping connection so as to by-pass the shuttle valve located within the faucet assembly 200. A valve 43 may be included that is self-tapping for ease of connection to the unfiltered fluid supply 45. With this embodiment, unfiltered fluid may be supplied directly to the unfiltered fluid inlet of the dispenser housing 12 without flow through the shuttle valve.

FIG. 15 depicts another embodiment of the present invention in which the dispenser housing 12 is connected to the water sprayer connection provided with the faucet assembly 200 of a conventional sink 210. In this embodiment, a boosting mechanism 220 is provided to assist the shuttle valve 230 into the desired operation when the filtered fluid dispensing system 10 is activated. Upon activating actuator 50 to a dispensing position, the boosting mechanism 220 acts upon the shuttle valve 230 to cause unfiltered fluid water flowing into the faucet assembly 200 to flow into the flexible conduit 42 and then into the unfiltered fluid inlet of the dispenser housing 12. The boosting mechanism may consist of an aligning boss 222 and a booster spring 224 in mechanical communication with the aligning boss 222. For installation, the user may simply remove cap 226, insert the boosting mechanism 220, and then replace the cap 226.

In still another embodiment of the present invention, a valve may be located at the water outlet 240 of the faucet assembly 200. By using this valve to prevent the flow of water from the water outlet 240, the shuttle valve causes water flowing into the faucet assembly 200 to flow into the flexible conduit 42 and therefore into the dispenser housing 12 when the present invention is activated. The shuttle valve 230 is thereby directed into the desired position for dispensing fluid from dispensing system 10.

While the invention has been described in detail with respect to specific embodiments thereof, it will be appreciated that those skilled in the art, upon attaining an understanding of the foregoing, may readily conceive of alterations to and variations of the embodiments disclosed herein. Such alterations and variations are believed to fall within the scope and spirit of the present invention and the appended claims.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged both in whole or in part. Therefore, the spirit and scope of the appended claims should not be limited to the description of the preferred versions contained therein.

What is claimed is:

1. A filtered fluid dispensing system, comprising:

a dispenser housing capable of being easily grasped by a user and capable of being releasably mounted on a sink;

an unfiltered fluid inlet through which unfiltered fluid may be supplied into the dispenser housing;

a flexible conduit with a first end connected to the unfiltered fluid inlet and a second end for connecting to an unfiltered fluid supply for providing unfiltered fluid into the dispenser housing;

a filtered fluid outlet through which filtered fluid may exit the dispenser housing;

a valve within said dispenser housing, said valve being in fluid communication with the unfiltered fluid inlet and the filtered fluid outlet;

a single actuator configured for activating both filtered and unfiltered fluid flow through said valve, said single actuator having a forward and a rearward portions in mechanical connection with the valve, whereby a flow of fluid through the dispenser housing is externally controlled by depressing one of the forward and rearward portions of said actuator to dispense filtered fluid flow, and depressing the other of said forward and rearward portions to dispense unfiltered fluid flow, and upon releasing of said portions of said single actuator, said single actuator moves to an off position wherein said valve is positioned to prevent both filtered and unfiltered fluid flow from exiting said dispenser housing; and a filter disposed within said dispenser housing, said filter being in fluid communication with the unfiltered fluid inlet so that the dispensing system may provide filtered fluid through the filtered fluid outlet.

2. The filtered fluid dispensing system of claim 1, further comprising an unfiltered fluid outlet through which unfiltered fluid may exit the dispenser housing, and said valve being structured to allow selection of fluid flow through either the filtered fluid outlet or the unfiltered fluid outlet.

3. The filtered fluid dispensing system of claim 1, further comprising a second valve, said second valve being in fluid communication with said flexible conduit and being connectable to said unfiltered fluid supply, whereby the second valve may control the flow of fluid into the flexible conduit.

4. The filtered fluid dispensing system of claim 3, wherein said second valve is self-tapping for connection to the unfiltered fluid Supply.

5. The filtered fluid dispensing system of claim 1, wherein the second end of the flexible conduit has a clamping structure adapted for mating with a water sprayer connection provided with a faucet assembly of a conventional sink.

6. The filtered fluid dispensing system of claim 5, further comprising:

a shuttle valve boosting mechanism;

said boosting mechanism being adapted for fitting within a faucet assembly used with a conventional sink and having a shuttle valve;

wherein upon activating the actuator in mechanical communication with the valve, the booster mechanism acts upon the shuttle valve to cause unfiltered water flowing into the faucet assembly to flow into the flexible conduit.

7. The filtered fluid dispensing system of claim 6, wherein said booster mechanism comprises an aligning boss; and a booster spring in mechanical communication with the aligning boss.

8. The filtered fluid dispensing system of claim 1, further comprising an indicator for notifying the user when the filter has reached the end of its useful life.

9. The filtered fluid dispensing system of claim 1, further comprising a nozzle in fluid communication with the filtered fluid outlet for producing a spray of filtered fluid.

10. The filtered fluid dispensing system of claim 1, further comprising a dispenser support for releasably mounting the dispensing system to a surface.

11. A filtered fluid dispensing system comprising:

a dispenser housing;

an unfiltered fluid inlet through which unfiltered fluid may be supplied into the dispenser housing;

a flexible conduit with a first end connected to the unfiltered fluid inlet and a second end for connecting to an unfiltered fluid supply for providing unfiltered fluid into the dispenser housing;

a filtered fluid outlet through which filtered fluid may exit the dispenser housing;

an unfiltered fluid outlet through which unfiltered fluid may exit the dispenser housing;

a valve within said dispenser housing, said valve being in fluid communication with the unfiltered fluid inlet, the filtered fluid outlet and the unfiltered fluid outlet, said valve constructed to allow selection of fluid flow through either the filtered fluid outlet or the unfiltered fluid outlet;

a single actuator configured for activating both filtered and unfiltered fluid flow through said valve, said single actuator having a forward and a rearward portions in mechanical connection with the valve, whereby a flow of fluid through the dispenser housing is externally controlled by depressing one of the forward and rearward portions of said actuator to dispense filtered fluid flow, and depressing the other of said forward and rearward portions to dispense unfiltered fluid flow, and upon releasing said portions of said single actuator, said single actuator moves to an off position wherein said valve is positioned to prevent both filtered and unfiltered fluid flow from exiting said dispenser housing; and a filter disposed within said dispenser housing, said filter being in fluid communication with the unfiltered fluid inlet so that the dispensing system may provide filtered fluid through the filtered fluid outlet.

12. The filtered fluid dispensing system of claim 11, wherein the second end of the flexible conduit has a clamping structure adapted for mating with a water sprayer connection provided with a faucet assembly of a conventional sink.

13. The filtered fluid dispensing system of claim 12, further comprising:

a shuttle valve boosting mechanism;

said boosting mechanism being adapted for fitting within a faucet assembly used with a conventional sink and having a shuttle valve;

wherein upon activating the actuator in mechanical communication with the valve the booster mechanism acts upon the shuttle valve to cause unfiltered water flowing into a faucet assembly to flow into the flexible conduit.

14. The filtered fluid dispensing system of claim 13, wherein said booster mechanism comprises an aligning boss; and, a booster spring in mechanical communication with the aligning boss.

15. The filtered fluid dispensing system of claim 11, further comprising a second valve, said second valve being in fluid communication with said flexible conduit and being connectable to said unfiltered fluid supply, whereby the second valve may control the flow of fluid into the flexible conduit.

16. The filtered fluid dispensing system of claim 15, wherein said second valve is self-tapping for connection to the unfiltered fluid supply.

17. The filtered fluid dispensing system of claim 11, further comprising an indicator for notifying the user when the filter has reached the end of its useful life.

18. The filtered fluid dispensing system of claim 11, further comprising a nozzle in fluid communication with the filtered fluid outlet for producing a spray of filtered fluid.

19. The filtered fluid dispensing system of claim 11, further comprising a dispenser support for releasably mounting the dispensing system to-a-surface.

20. A filtered fluid dispensing system comprising:

a dispenser housing having a forward portion extending from a central portion;

an unfiltered fluid inlet through which unfiltered fluid may be supplied into the dispenser housing;

a flexible conduit with a first end connected to the unfiltered fluid inlet and a second end for connecting to an unfiltered fluid supply for providing unfiltered fluid into the dispenser housing;

a filtered fluid outlet through which filtered fluid may exit the dispenser housing;

an unfiltered fluid outlet through which unfiltered fluid may exit the dispenser housing;

a single valve having a shuttle within said dispenser housing, said valve being in fluid communication with the unfiltered fluid inlet, the filtered fluid outlet and the unfiltered fluid outlet, said valve constructed to allow selection of fluid flow through either the filtered fluid outlet or the unfiltered fluid outlet;

a first actuator in mechanical connection with the valve, said first actuator disposed on one side of said forward portion of said dispenser housing, whereby the flow of filtered fluid through the dispenser housing may be externally controlled by moving said first actuator towards said forward portion of said dispenser housing;

a second actuator in mechanical connection with the valve, said second actuator disposed on a side of said forward portion of said dispenser housing generally opposite from said first actuator, whereby the flow of filtered fluid through the dispenser housing may be externally controlled by moving said second actuator towards said forward portion of said dispenser housing; and a filter disposed within said dispenser housing, said filter being in fluid communication with the unfiltered fluid inlet so that the dispensing system may provide filtered fluid through the filtered fluid outlet.

21. The filtered fluid dispensing system of claim 20, further comprising a flexible conduit with a first end connected to the unfiltered fluid inlet and a second end for connecting to an unfiltered fluid supply for providing unfiltered fluid into the dispenser housing.

22. The filtered fluid dispensing system of claim 21, further comprising a second valve, said second valve being in fluid communication with said flexible conduit and being connectable to said unfiltered fluid supply, whereby the second valve may control the flow of fluid into the flexible conduit.

23. The filtered fluid dispensing system of claim 24, wherein said second valve is self-tapping for connection to the unfiltered fluid supply.

24. The filtered fluid dispensing system of claim 20, further comprising a flexible conduit with a first end connected to the unfiltered fluid inlet and a second end adapted for mating with a water sprayer connection provided with a faucet assembly of a conventional sink.

25. The filtered fluid dispensing system of claim 21, further comprising:

a shuttle valve boosting mechanism;

said boosting mechanism being adapted for fitting within a faucet assembly used with a conventional sink and having a shuttle valve;

wherein upon activating either the first or the second actuator in mechanical communication with the valve the booster mechanism acts upon the shuttle valve to cause unfiltered water flowing into the faucet assembly to flow into the flexible conduit.

26. The filtered fluid dispensing system of claim 22, wherein said booster mechanism comprises an aligning boss; and a booster spring in mechanical communication with the aligning boss.

27. The filtered fluid dispensing system of claim 20, further comprising an indicator for notifying the user when the filter has reached the end of its useful life.

28. The filtered fluid dispensing system of claim 20, further comprising a nozzle in fluid communication with the filtered fluid outlet for producing a spray of filtered fluid.

29. The filtered fluid dispensing system of claim 20, further comprising a dispenser support for releasably mounting the dispensing system to a surface.

* * * * *